US012235054B2

(12) United States Patent
Shin et al.

(10) Patent No.: US 12,235,054 B2
(45) Date of Patent: Feb. 25, 2025

(54) INTEGRATED CONNECTOR AND HEAT EXCHANGER INCLUDING THE SAME

(71) Applicant: Hanon Systems, Daejeon (KR)

(72) Inventors: Seung Hark Shin, Daejeon (KR); Woon Sik Kim, Daejeon (KR); Dae Sung Noh, Daejeon (KR); Hyunwoo Cho, Daejeon (KR); Min Won Seo, Daejeon (KR); Sung Hong Shin, Daejeon (KR); Jong Du Lee, Daejeon (KR); Jung Hyun Cho, Daejeon (KR); Uk Huh, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 36 days.

(21) Appl. No.: 18/373,354

(22) Filed: Sep. 27, 2023

(65) Prior Publication Data

US 2024/0133642 A1 Apr. 25, 2024
US 2024/0230251 A9 Jul. 11, 2024

(30) Foreign Application Priority Data

Oct. 21, 2022 (KR) ..... 10-2022-0136083

(51) Int. Cl.
*F28F 9/02* (2006.01)
*F28F 19/00* (2006.01)

(52) U.S. Cl.
CPC ..... *F28F 9/0256* (2013.01); *F28F 19/00* (2013.01); *F28F 2220/00* (2013.01);
(Continued)

(58) Field of Classification Search
CPC ..... F28F 9/0256; F28F 19/00; F28F 2220/00; F28F 2250/08; F28F 2265/18; F28F 2275/10; F28F 9/0246
(Continued)

(56) References Cited

U.S. PATENT DOCUMENTS 5,713,217 A * 2/1998 Baba ..... F25B 39/04 62/509
7,024,884 B2 * 4/2006 Kent ..... F25B 39/04 62/509
(Continued)

FOREIGN PATENT DOCUMENTS

KR 100928807 B1 * 2/2003
KR 102159643 B1 * 11/2018
(Continued)

*Primary Examiner* — Jon T. Schermerhorn, Jr.
(74) *Attorney, Agent, or Firm* — NORTON ROSE FULBRIGHT US LLP

(57) ABSTRACT

The present invention relates to an integrated connector and a heat exchanger including the same, in which a connector main body is formed by pressing one pipe, a cap is press-fitted into the connector main body, such that the integrated connector is formed so that an interior of the connector main body is blocked by the cap. Therefore, the number of components used to manufacture a connector, which connects and securely couples a header tank and a gas-liquid separator, may be reduced, the integrated connector may be easily manufactured, and a brazing defect may be reduced at portions where the integrated connector is joined to the header tank and the gas-liquid separator of the heat exchanger.

20 Claims, 19 Drawing Sheets

(52) U.S. Cl.
CPC ..... *F28F 2255/08* (2013.01); *F28F 2265/18* (2013.01); *F28F 2275/10* (2013.01)

(58) Field of Classification Search
USPC ..... 165/143
See application file for complete search history.

(56) References Cited

U.S. PATENT DOCUMENTS

| | | | | |
|---|---|---|---|---|
| 10,041,740 | B2 * | 8/2018 | Takase | F28F 9/0246 |
| 10,352,601 | B2 * | 7/2019 | Morimoto | F28D 1/05391 |
| 2024/0068719 | A1 * | 2/2024 | Shin | F28D 9/0043 |
| 2024/0102747 | A1 * | 3/2024 | Yuan | F28F 9/0246 |

FOREIGN PATENT DOCUMENTS

| | | | |
|---|---|---|---|
| KR | 102159649 | B1 * | 11/2018 |
| KR | 2022-0113273 | A | 8/2022 |

* cited by examiner

INTEGRATED CONNECTOR AND HEAT EXCHANGER INCLUDING THE SAME

CROSS REFERENCE TO RELATED APPLICATION

The present application claims priority to Korean Patent Application No. 10-2022-0136083, filed on Oct. 21, 2022, the entire contents of which are incorporated herein for all purposes by this reference.

BACKGROUND OF THE INVENTION

Field of the Invention

The present invention relates to a connector, which connects and fixes a header tank and a gas-liquid separator in a heat exchanger such as a condenser, and the heat exchanger including the same.

Description of the Related Art

A heat exchanger refers to a device disposed between two environments having a temperature difference and configured to absorb heat from one environment and discharge the heat to the other environment. Among the heat exchangers, a condenser refers to a heat exchanger that cools a refrigerant by allowing the refrigerant to exchange heat with air or a coolant.

FIG. 1 is a perspective view illustrating a condenser in the related art.

As illustrated, the condenser in the related art may include first and second header tanks 11 and 12 disposed to be spaced apart from each other and configured such that a refrigerant flows therein, a core part 10C including a plurality of fins and a plurality of tubes each having two opposite ends connected to and configured to communicate with the first and second header tanks 11 and 12, and a gas-liquid separator 60 disposed to be spaced apart from the first header tank 11 and coupled to the first header tank 11 by means of transfer connectors 70 and a blind connector 80. Further, the transfer connector 70 serves to connect the first header tank 11 and the gas-liquid separator 60 and allow a heat exchange medium to flow. In addition, the blind connector 80 is used to connect and fix the first header tank 11 and the gas-liquid separator 60. The blind connector 80 has a similar shape to the transfer connector 70 and has a shape with a blocked interior. One side of the blind connector is joined to the header tank, and the other side of the blind connector is joined to the gas-liquid separator. FIG. 2 is a cross-sectional view illustrating the transfer connector 70, and FIG. 3 is a cross-sectional view illustrating the blind connector 80. As illustrated, the transfer connector 70 is manufactured by forming a connection block 71 by cold forging or the like and then inserting a clad pipe 72, which has an outer surface on which a clad layer is famed, into the connection block 71. In contrast, the blind connector 80 is manufactured by forming a shape, which has a blocked interior, by processing a connection portion 81 and pipe portions 82 and 83 into an integrated shape by performing cold forging or the like on a metal block, and then inserting a clad ring into outer portions of the pipe portions 82 and 83 for brazing.

Therefore, in the related art, there are problems in that the number of components of the connector to be manufactured increases, the connector is complicated, it is difficult to manufacture the connector, and joint defects occur on portions where the blind connector is coupled to the header tank and the gas-liquid separator by brazing.

Document of Related Art

KR 10-2022-0113273 A (Aug. 12, 2022)

SUMMARY OF THE INVENTION

The present invention is proposed to solve these problems and aims to provide an integrated connector used to connect and securely couple a header tank and a gas-liquid separator in a heat exchanger such as a condenser, the connector being easily manufactured by a reduced number of components, and a heat exchanger including the same.

The present invention also aims to provide an integrated connector capable of reducing a brazing defect at portions where the integrated connector is joined to a header tank and a gas-liquid separator, and a heat exchanger including the same.

To achieve the above-mentioned objects, the present invention provides an integrated connector including: a connector main body including first and second pipe portions each provided in the form of a pipe, and first and second flange portions positioned between the first and second pipe portions and each formed in a shape in which the pipe is folded outward so that the folded portions overlap each other at ends of the first and second pipe portions facing each other, the connector main body having a communicating interior as the first and second pipe portions and the first and second flange portions are integrated; and a cap inserted and coupled into the connector main body and configured to block the communicating interior of the connector main body to block connection.

In addition, the connector main body may further include: first bent portions configured to connect the first pipe portion and the first flange portion and connect the second pipe portion and the second flange portion; second bent portions configured to connect radially outer side folded portions of the first flange portion and connect radially outer side folded portions of the second flange portion; and a connection portion configured to connect the first and second flange portions.

In addition, at least a part of the cap may be disposed at a position that overlaps the first or second flange portion in a longitudinal direction.

The cap may include: a blocking portion configured to block an interior of the connector main body; and a contact portion extending from the blocking portion in a direction in which the cap is inserted into the connector main body, the contact portion being in contact with and coupled to the connector main body.

In addition, the cap may further include a round portion having a curved surface that gently connects the blocking portion and the contact portion.

In addition, a protruding portion may be formed on an inner portion of the connection portion of the connector main body and further protrude inward than an inner peripheral surface of the first pipe portion or an inner peripheral surface of the second pipe portion, and the cap may be caught by and in contact with the protruding portion.

In addition, based on a centerline of the connection portion of the connector main body, at least a part of the blocking portion of the cap may be disposed at one side based on a longitudinal direction, and the contact portion of the cap may be disposed at the other side based on a longitudinal direction of the connector main body.

In addition, based on a centerline of the connection portion of the connector main body, the blocking portion of the cap may be disposed at one side based on a longitudinal direction, and the contact portion of the cap may be disposed at the other side based on a longitudinal direction of the connector main body.

In addition, based on the centerline of the connection portion, a thickness of the blocking portion of the cap, which is disposed at one side based on the longitudinal direction, may be 0.3 mm to 0.4 mm.

In addition, the cap may include: a blocking portion configured to block an interior of the connector main body; a contact portion extending from the blocking portion in a direction in which the cap is inserted into the connector main body, the contact portion being in contact with and coupled to the connector main body; and a round portion having a curved surface that gently connects the blocking portion and the contact portion.

In addition, a protrusion or groove may be formed on an outer surface of the contact portion of the cap, or an outer surface of the contact portion may be formed in a pleated shape.

In addition, a clad layer may be formed on an outer surface of the cap.

In addition, a clad layer may be formed on an outer surface of the connector main body.

In addition, the first and second pipe portions and the first and second flange portions of the connector main body may be formed in an integrally connected shape by forming processing that forms the first and second flange portions folded to overlap each other by compressing one pipe.

In addition, the first and second pipe portions of the connector main body may have different outer diameters.

In addition, the cap may be inserted into one of the first and second pipe portions of the connector main body that has a relatively large outer diameter, and a contact portion of the cap may be disposed to be directed toward a side at which the outer diameter is relatively large, and a blocking portion of the cap may be disposed to be directed toward a side at which the outer diameter is relatively small.

Further, the present invention provides a heat exchanger including: one or more header tanks configured to store a heat exchange medium and allow the heat exchange medium to flow; a core part connected to the header tank and configured to allow the heat exchange medium to flow and perform heat exchange; a gas-liquid separator disposed to be adjacent to and spaced apart from the header tank; and the integrated connector according to claim 1 that has one side coupled to the header tank, and the other side coupled to the gas-liquid separator.

In addition, the integrated connector may be configured such that the first pipe portion is inserted into a hole of the header tank, the first flange portion is coupled to an outer surface of the header tank by means of surface contact, the second pipe portion is inserted into a hole of the gas-liquid separator, and the second flange portion is coupled to an outer surface of the gas-liquid separator by means of surface contact.

In addition, the present invention provides a method of manufacturing an integrated connector, the method including: a connector main body forming step of integrally forming, at one side, a first flange portion, in a shape in which a pipe is folded outward so that the folded portions overlap each other, and forming, at the other side, a second flange portion, in a shape in which the pipe is folded outward so that the folded portions overlap each other, based on a central portion of the pipe based on a longitudinal direction by pressing the pipe from two opposite sides based on the longitudinal direction of the pipe in a state in which the central portion of the pipe, which is a forming object, based on the longitudinal direction is fixed, such that a first pipe portion integrally extends outward from the first flange portion in the longitudinal direction, and a second pipe portion integrally extends outward from the second flange portion; and a cap coupling step of press-fitting a cap into a connector main body so that an interior of the connector main body is blocked by the cap, and connection is blocked.

In addition, in the cap coupling step, a stopper may be inserted into the connector main body at a side opposite to the side at which the cap is inserted into the connector main body, and then the cap may be inserted and coupled into the connector main body.

In addition, the first and second pipe portions of the connector main body manufactured in the connector main body forming step may have different outer diameters, and the cap coupling step, the stopper may be inserted into one of the first and second pipe portions that has a relatively small outer diameter, and the cap may be inserted into the other of the first and second pipe portions that has a relatively large outer diameter.

In addition, the present invention provides a method of manufacturing an integrated connector, the method including: a cap assembling step of press-fitting a cap into a pipe, which is a forming object, so that an interior of the pipe is blocked by the cap and connection is blocked; and a connector main body forming step of integrally forming, at one side, a first flange portion, in a shape in which the pipe is folded outward so that the folded portions overlap each other, and forming, at the other side, a second flange portion, in a shape in which the pipe is folded outward so that the folded portions overlap each other, based on a central portion of the pipe based on a longitudinal direction by pressing the pipe from two opposite sides based on the longitudinal direction of the pipe after the central portion of the pipe, which is the forming object, based on the longitudinal direction is fixed in a state in which the cap is press-fitted into the pipe, such that a first pipe portion integrally extends outward from the first flange portion in the longitudinal direction, and a second pipe portion integrally extends outward from the second flange portion.

DETAILED DESCRIPTION OF THE INVENTION

Figure 1:
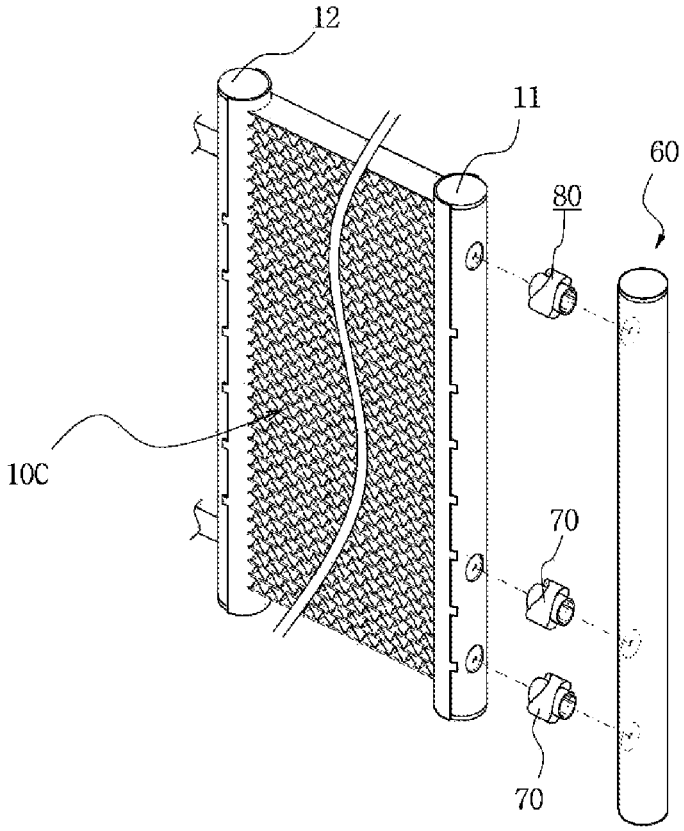
FIG. 1 is a perspective view illustrating a condenser in the related art.
Figure 2:
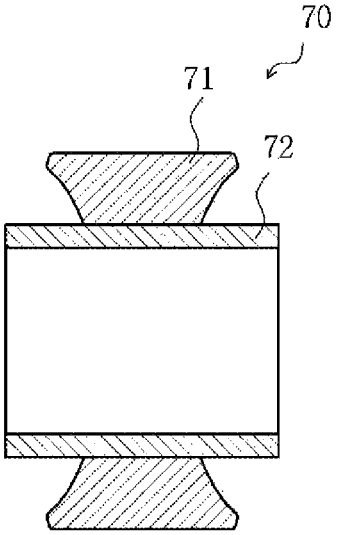
FIGS. 2 and 3 are cross-sectional views illustrating a transfer connector and a blind connector of the condenser in the related art.
Figure 3:
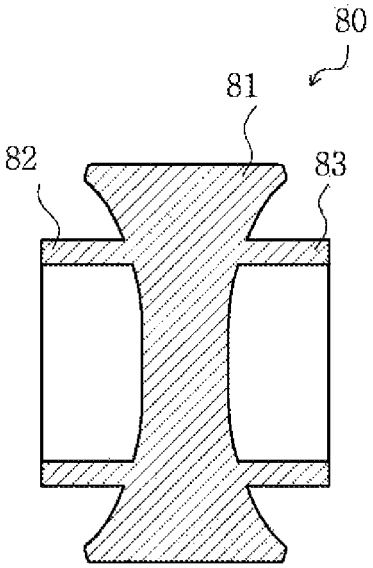
Figure 4:
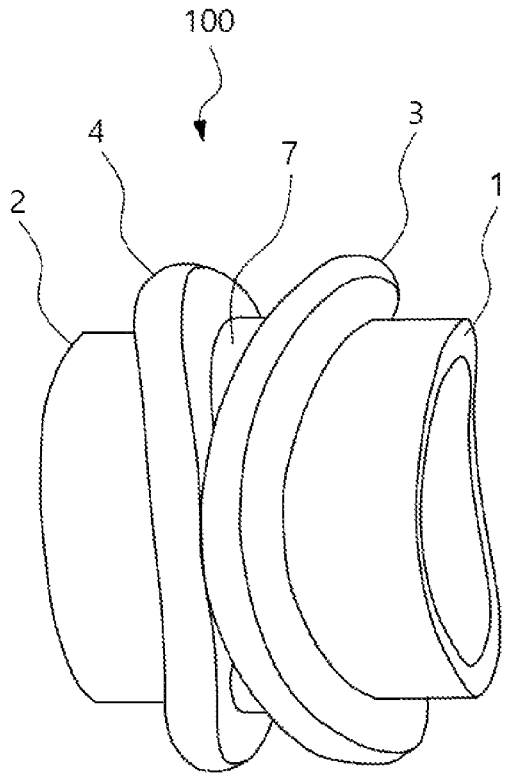
FIGS. 4 to 7 are photographs illustrating an integrated connector according to an embodiment of the present invention and cross-sectional views made by cutting the integrated connector at different angles.
Figure 5:
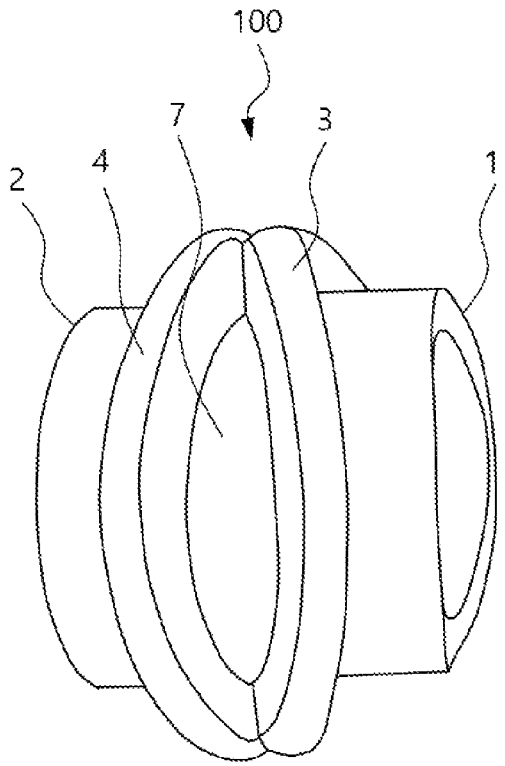
Figure 6:
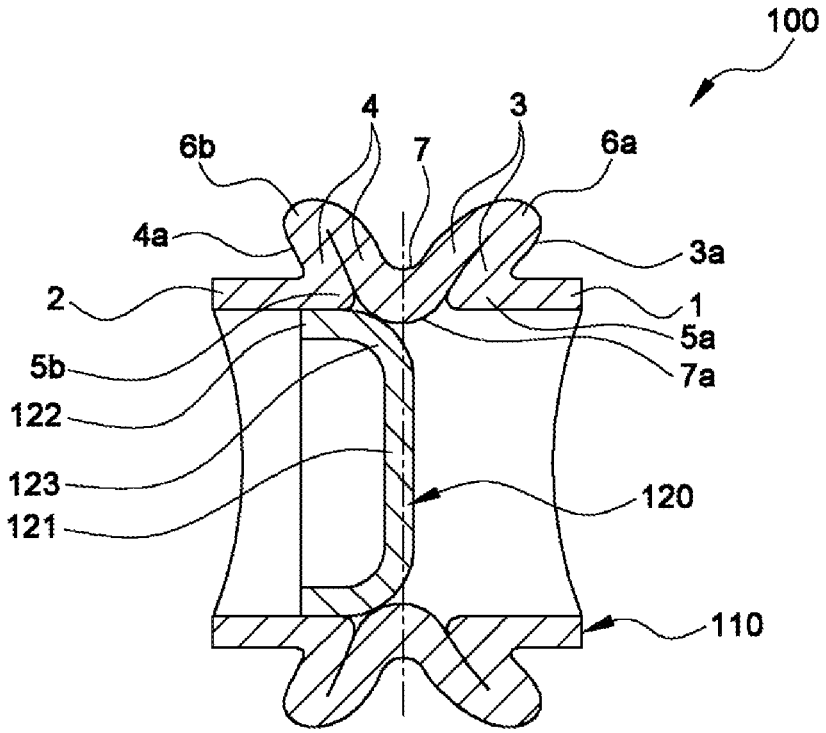
Figure 7:
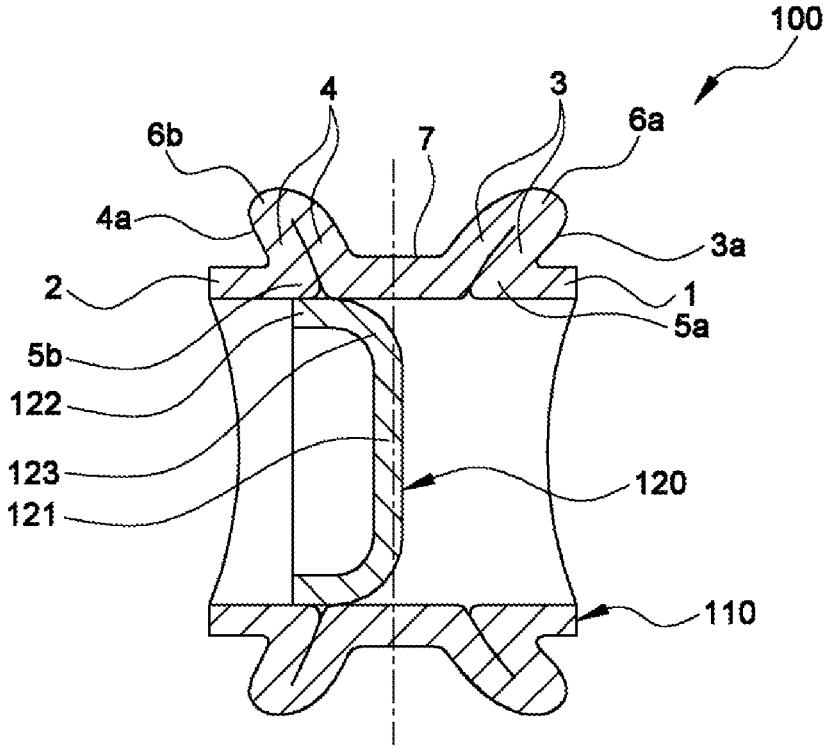

Hereinafter, an integrated connector and a heat exchanger including the same of the present invention configured as described above will be described in detail with reference to the accompanying drawings.

<Embodiment of Integrated Connector>

FIGS. 4 to 7 are photographs illustrating an integrated connector according to an embodiment of the present invention and cross-sectional views made by cutting the integrated connector at different angles.

As illustrated, the integrated connector according to the embodiment of the present invention may broadly include a connector main body 110 and a cap 120.

The connector main body 110 may include a first pipe portion 1, a second pipe portion 2, a first flange portion 3, and a second flange portion 4 and further include first bent portions 5*a* and 5*b*, second bent portions 6*a* and 6*b*, and a connection portion 7.

The first and second pipe portions 1 and 2 may each be provided in the form of a hollow pipe. The first pipe portion 1 may be disposed at one side based on a longitudinal direction, and the second pipe portion 2 may be disposed at the other side based on the longitudinal direction. The first and second flange portions 3 and 4 may be disposed between the first and second pipe portions 1 and 2. The first flange portion 3 may be disposed adjacent to the first pipe portion 1, and the second flange portion 4 may be disposed adjacent to the second pipe portion 2. Further, the first and second flange portions 3 and 4 are formed to protrude outward from outer peripheral surfaces of the first and second pipe portions 1 and 2. The first and second flange portions 3 and 4 may each be formed in a shape in which the pipe is folded so that the folded portions overlap each other. In addition, the first and second flange portions 3 and 4 may each be famed in a hollow shape, such that interiors of the first and second flange portions 3 and 4 may be penetratively formed from the first pipe portion 1, which is one side based on the longitudinal direction, to the second pipe portion 2 that is the other side based on the longitudinal direction.

In this case, in the connector main body 110, the first and second flange portions 3 and 4 may be integrally formed to be adjacent to each other by compressing a single pipe in the longitudinal direction so that central portions based on the longitudinal direction are folded to overlap each other. The first pipe portion 1 may integrally extend in one direction from one end of the first flange portion 3, and the second pipe portion 2 may integrally extend in the other direction from the other end of the second flange portion 4. In this case, the integrated connector may be manufactured in a desired dimension and shape by means of forming processing that compresses a single tube by using a mold manufactured in advance in a shape corresponding to a shape to be formed.

More specifically, the connector main body 110 has a straight pipe shape extending from one end of the first pipe portion 1 to the other end of the first pipe portion 1. The connector main body 110 has the first and second flange portions 3 and 4 extending in an approximately "M" shape from the other end of the first pipe portion 1 toward an outer side of an outer peripheral surface of the first pipe portion 1. The second pipe portion 2 has a straight pipe shape extending in one direction from one end of the second flange portion 4. That is, the first pipe portion 1, the first flange portion 3, the second flange portion 4, and the second pipe portion 2 of the connector main body 110 may be integrally connected to be adjacent to one another in a seamless manner. The two opposite ends of the connector main body 110 may be opened, and the interiors of the first pipe portion 1, the first flange portion 3, the second flange portion 4, and the second pipe portion 2 may communicate with one another. Further, the connector main body 110 may have the first bent portion 5*a* made as the other end of the first pipe portion 1 and a radially inner side of one end of the first flange portion 3 are connected in a bent shape. Likewise, the connector main body 110 may have the first bent portion 5*b* made as one end of the second pipe portion 2 and a radially inner side of the other end of the second flange portion 4 are connected in a bent shape. In addition, two layers of the first flange portion 3 may define the second bent portion 6*a* in which radially outer sides thereof are connected to each other in a bent shape. Likewise, two layers of the second flange portion 4 may also define the second bent portion 6*b* in which radially outer sides thereof are connected to each other in a bent shape. In addition, the connection portion 7 may be formed as a radially inner side of the other side of the first flange portion 3 and a radially inner side of one side of the second flange portion 4 are connected to each other in a bent shape. Therefore, the bent shapes of the first bent portions 5*a* and 5*b*, the bent shapes of the second bent portions 6*a* and 6*b*, and the bent shape of the connection portion 7 may improve the structural rigidity of the first and second flange portions 3 and 4. In addition, the connection portion 7 may be famed in a straight shape between the first and second flange portions 3 and 4. In addition, a clad layer may be famed on an outer surface of the connector main body 110, such that the connector main body 110 may be easily joined to a header tank and a gas-liquid separator of a heat exchanger, such as a condenser, by brazing.

The cap 120 may be inserted and coupled into the connector main body 110. The cap 120 may serve to block connection by blocking the communicating interior of the connector main body 120. That is, the integrated connector of the present invention is formed such that the interior of connector main body 120 is blocked by the cap 120. Therefore, the integrated connector may serve as a blind connector that may block a flow of a fluid through the integrated connector. The blind connector serves to connect and fix the header tank and the gas-liquid separator in the heat exchanger such as the condenser. The interior of the blind connector is blocked to block a flow of the fluid. The cap 120 may be disposed in a region in which the first and second flange portions 3 and 4 of the connector main body 110 are positioned, which may improve the structural rigidity of the first and second flange portions 3 and 4. In addition, a clad layer may be formed on an outer surface of the cap 120, such that the cap 120 may be easily joined to an inner surface of the connector main body 110 by brazing.

Therefore, the integrated connector of the present invention may have a small number of components and be easily manufactured. Further, it is possible to reduce a brazing defect at the portions where the integrated connector is joined to the header tank and the gas-liquid separator of the heat exchanger. In addition, the integrated connector may be used as a transfer connector connected to allow a flow of a fluid by using only the connector main body. Alternatively, the integrated connector may be used as the blind connector made by coupling the cap to the connector main body to block a flow of a fluid. Therefore, the components of the integrated connector may be used in common or interchangeably.

In addition, the cap 120 may include a blocking portion 121, a contact portion 122, and a round portion 123 and be provided in the form of a cup having an approximately "U"-shaped cross-section. The blocking portion 121 may serve to block the interior of the connector main body 110. The blocking portion 121 may be formed in a direction perpendicularly intersecting a longitudinal direction of the connector main body 110. The contact portion 122 is formed in a cylindrical shape or a ring shape and famed in parallel with the longitudinal direction that is a direction in which the connector main body 110 is inserted. Further, the round portion 123 may have a curved surface having a shape convexly rounded outward to gently connect the blocking portion 121 and the contact portion 122. Therefore, at the time of inserting the cap 120 into the connector main body 110, the blocking portion 121 is inserted first, such that the round portion 123 may facilitate the insertion of the cap 120. In addition, the contact portion 122 is in contact with an inner peripheral surface of the connector main body 110, such that the cap 120 may be easily assembled and fixed to the connector main body 110 before the cap 120 is joined to the connector main body 110 by brazing.

In addition, based on a centerline of the connection portion 7 of the connector main body 110, at least a part of the blocking portion 121 of the cap 120 may be disposed at one side in the longitudinal direction, and the contact portion 122 may be disposed at the other side based on the longitudinal direction. For example, based on the centerline of the connection portion 7, the cap 120 may be disposed so that the blocking portion 121 passes over the centerline from the other side, at which the connector main body 110 is inserted, to one side. That is, the cap 120 may be disposed so that the blocking portion 121 is biased toward one side from the centerline. In this case, based on the centerline of the connection portion 7, a thickness of the blocking portion 121 of the cap 120 disposed at one side based on the longitudinal direction may be within a range of 0.3 mm to 0.4 mm.

Therefore, the contact portion 122 and the round portion 123 of the cap 120 may be maximally in contact with the connector main body 110, which may further improve the structural rigidity when the connector main body 110 and the cap 120 are joined by brazing.

In addition, a protruding portion 7*a* may be formed on an inner side of the connection portion 7 of the connector main body 110, and the protruding portion 7*a* may further protrude inward than an inner peripheral surface of the first pipe portion 1 or an inner peripheral surface of the second pipe portion 2. Further, a depth to which the cap 120 is inserted while being caught by the protruding portion 7*a* may be restricted, and the round portion 123 of the cap 120 may be in contact with and joined to the protruding portion 7*a*, thereby improving coupling strength.

Figure 8:
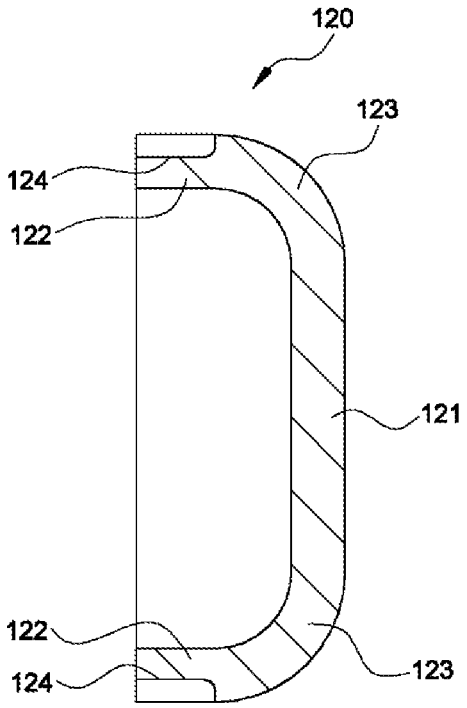
FIGS. 8 and 9 are a front cross-sectional view and a cross-sectional side view illustrating an embodiment of a cap of the integrated connector according to the present invention.
Figure 9:
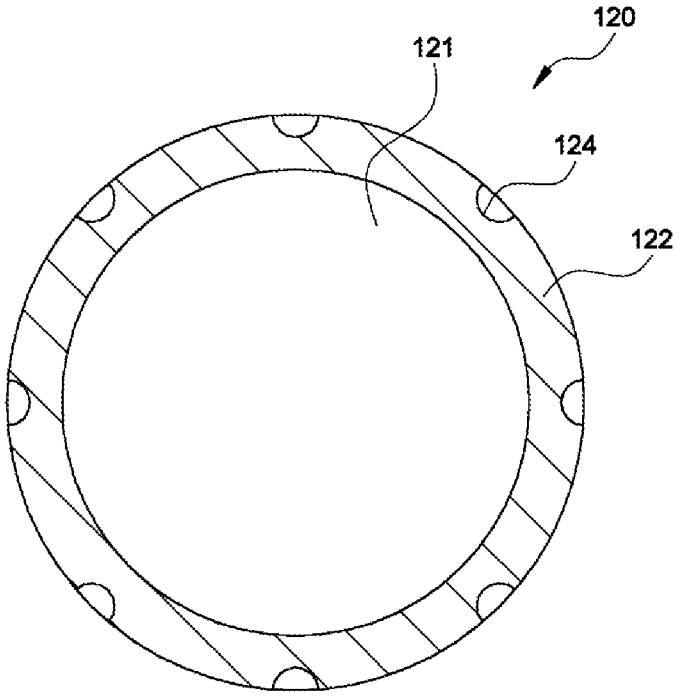
Figure 9A:
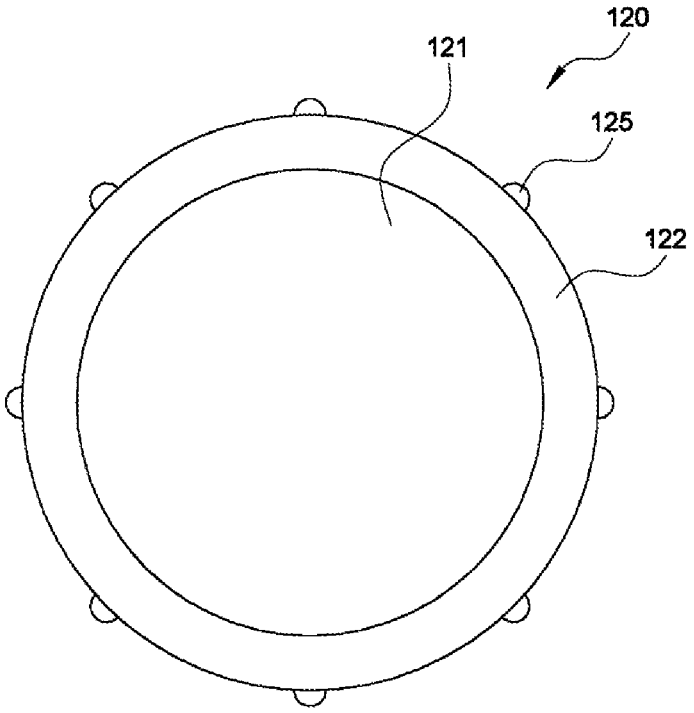
FIGS. 9A to 9C are side views illustrating another embodiment of the cap of the integrated connector according to the present invention.
Figure 9B:
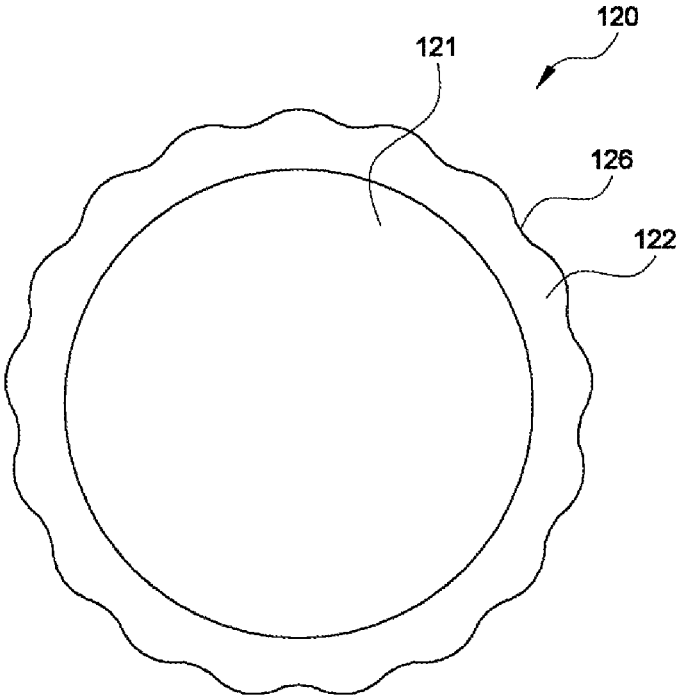

FIGS. 8 and 9 are a front cross-sectional view and a cross-sectional side view illustrating the cap of the integrated connector according to the embodiment of the present invention, and FIGS. 9A and 9B are side views illustrating another embodiment of the cap of the integrated connector according to the present invention.

Figure 9C:
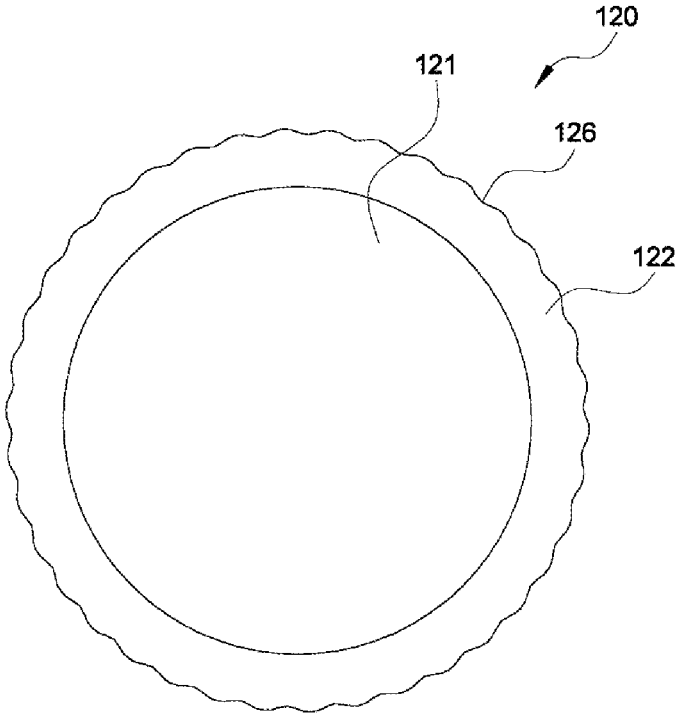

As illustrated in FIGS. 8 and 9, concave grooves 124 may be famed in an outer peripheral surface of the contact portion 122 of the cap 120. Alternatively, as illustrated in FIG. 9A, protrusions 125 may protrude from the outer peripheral surface of the contact portion 122. Alternatively, as illustrated in FIG. 9B or 9C, the outer peripheral surface of the contact portion 122 may have a convex-concave surface 126 having a pleated shape. Therefore, it is possible to increase the coupling strength between the connector main body 110 and the cap 120. Further, bubbles may be properly discharged from a portion between surfaces that are in contact with each other when the connector main body 110 and the cap 120 are joined by brazing. Therefore, a molten material may smoothly flow, which may improve bondability made by brazing.

Figure 10:
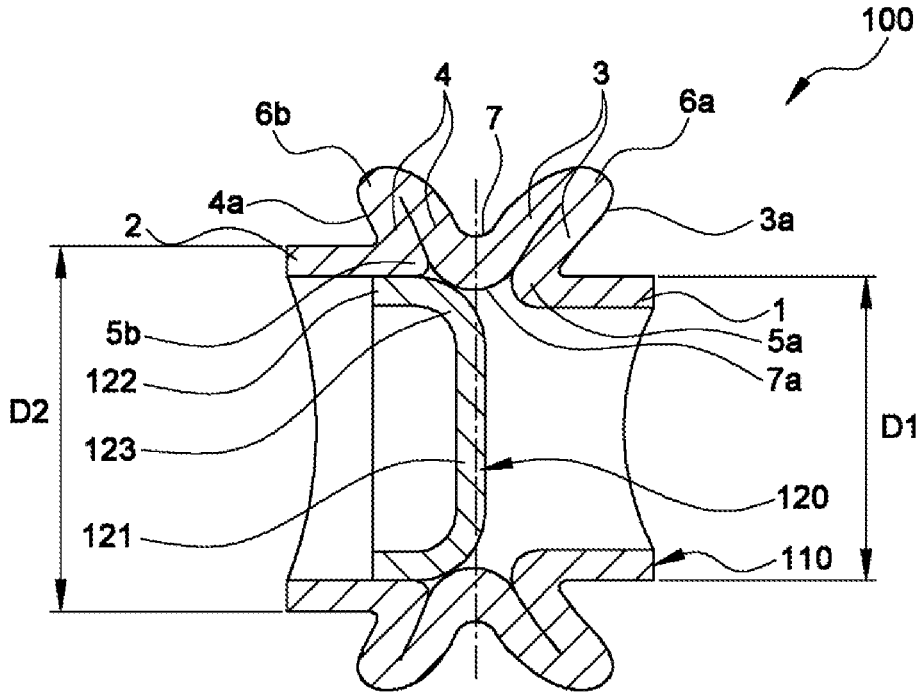
FIGS. 10 and 10A are a front cross-sectional view illustrating an integrated connector according to another embodiment of the present invention and a photograph made before the integrated connector is assembled.
Figure 10A:
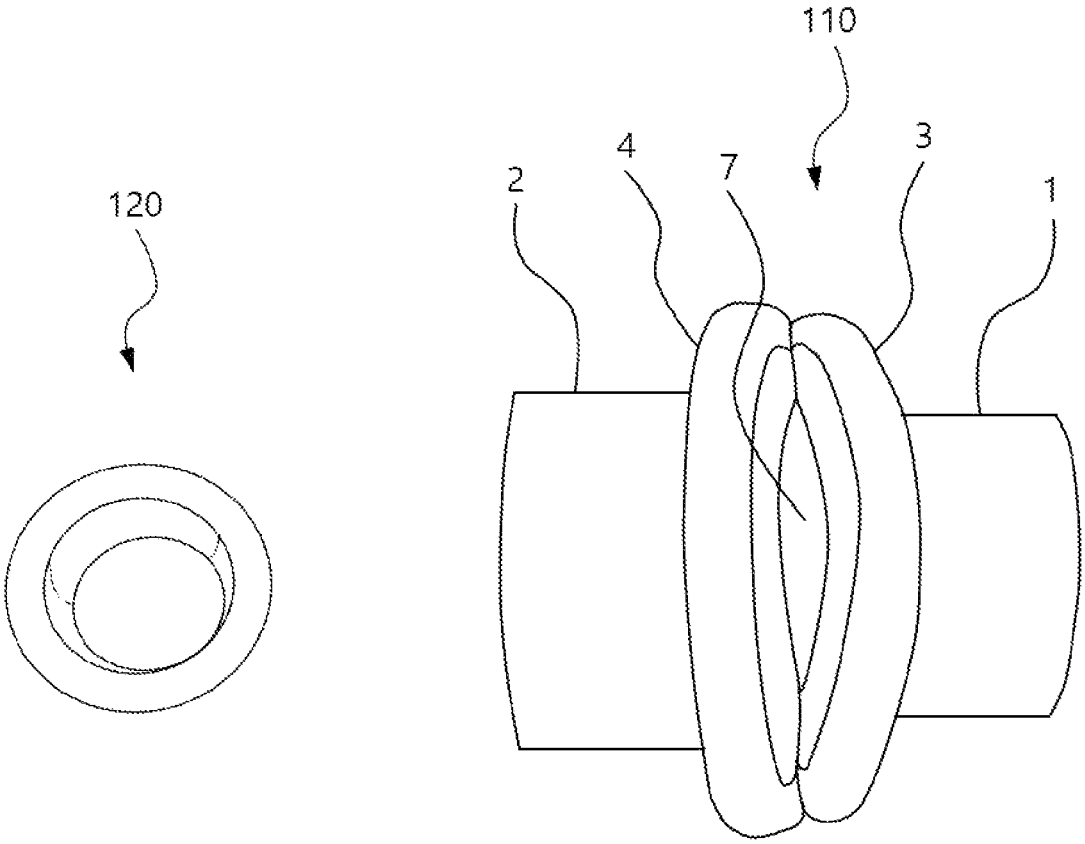

FIGS. 10 and 10A are a front cross-sectional view illustrating an integrated connector according to another embodiment of the present invention and a photograph made before the integrated connector is assembled.

As illustrated in FIGS. 4 to 7, the connector main body 110 may be formed such that outer diameters of the first and second pipe portions 1 and 2 are equal to each other. As illustrated in FIGS. 10 and 10A, an outer diameter D1 of the first pipe portion 1 and an outer diameter D2 of the second pipe portion 2 may be different from each other. For example, in case that the outer diameter D2 of the second pipe portion 2 is larger than the outer diameter D1 of the first pipe portion 1 of the connector main body 110, the cap 120 is inserted through the second pipe portion 2 having a relatively large outer diameter. Therefore, the cap 120 may be easily inserted into the connector main body 110, and the depth to which the cap 120 is inserted may be easily restrained. In this case, the contact portion 122 of the cap 120 may be disposed to be directed toward a portion of the connector main body 110 where the outer diameter is relatively large, and the blocking portion 121 may be disposed to be directed toward a portion of the connector main body 110 where the outer diameter is relatively small.

In addition, the first and second flange portions 3 and 4 may adjoin each other at one or more points. For example, the first and second flange portions 3 and 4 may be in contact with each other at two points of symmetric positions, which may improve the structural rigidity of the integrated connector. In addition, at least a part of the first flange portion 3 may be formed to be inclined toward the first pipe portion 1, and at least a part of the second flange portion 4 may be formed to be inclined toward the second pipe portion 2.

In this case, a first seating surface 3*a*, which is an outer right surface of the first flange portion 3 adjacent to the first pipe portion 1, may be formed in a shape corresponding to an outer surface of one object to which the first seating surface 3*a* is to be coupled by means of surface contact. For example, the first seating surface 3*a* may be formed in a shape corresponding to a cylindrical shape. Likewise, a second seating surface 4*a*, which is an outer left surface of the second flange portion 4 adjacent to the second pipe portion 2, may be formed in a shape corresponding to an outer surface of another object to which the second seating surface 4*a* is to be coupled by means of surface contact. For example, the second seating surface 4*a* may also be formed in a state corresponding to a cylindrical shape. In this case, as illustrated, the first seating surface 3*a* and the second seating surface 4*a* may be different in radii of curvature. In addition, the first seating surface 3*a* and the second seating surface 4*a* may be variously formed in accordance with external shapes of objects to which the first seating surface 3*a* and the second seating surface 4*a* are to be coupled by means of surface contact.

In addition, the first flange portion 3 may be formed in an annular shape that surrounds, by 360 degrees, the outer peripheral surface of the first pipe portion 1 in a circumferential direction, and the second flange portion 4 may be formed in an annular shape that surrounds, by 360 degrees, the outer peripheral surface of the second pipe portion 2 in the circumferential direction.

<Embodiment of Heat Exchanger>

Figure 11:
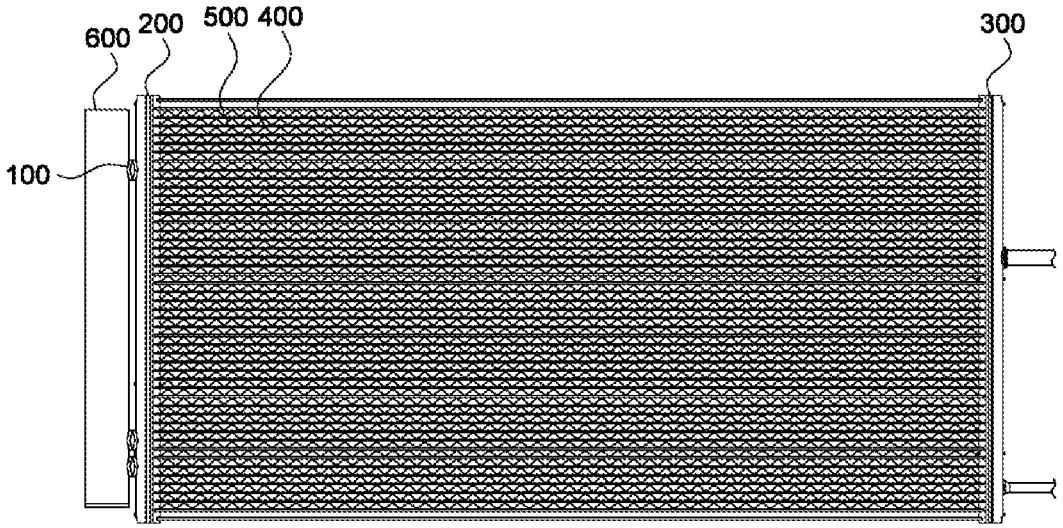
FIG. 11 is a front view illustrating a heat exchanger including the integrated connector according to the embodiment of the present invention.
Figure 12:
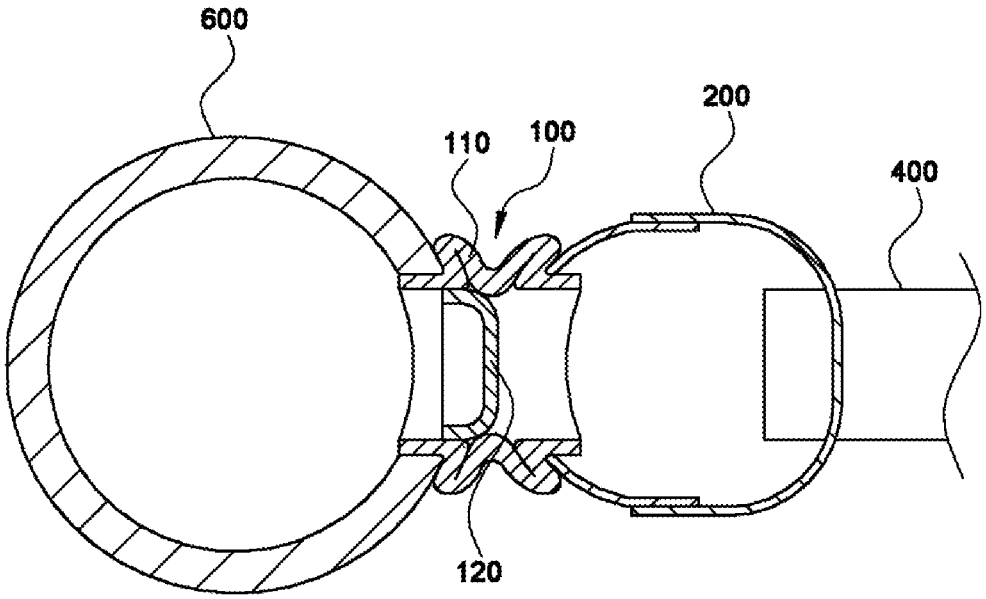
FIG. 12 is a top cross-sectional view illustrating a portion of the integrated connector in FIG. 11.

FIG. 11 is a front view illustrating a heat exchanger including the integrated connector according to the embodiment of the present invention, and FIG. 12 is a top cross-sectional view illustrating a portion of the integrated connector in FIG. 11.

As illustrated, the heat exchanger including the integrated connector according to the embodiment of the present invention may be a condenser. Further, for example, the heat exchanger may include a first header tank 200, a second header tank 300, a core part including a plurality of tubes 4000 and a plurality of heat radiating fins 500 where heat exchange substantially occurs, a gas-liquid separator 600, and the integrated connector 100.

The first and second header tanks 200 and 300 may each be provided in the form of a pipe with blocked two opposite ends so that the heat exchange medium may be stored and flow. For example, the first and second header tanks 200 and 300 may be spaced apart from each other and disposed side by side. Further, the first and second header tanks 200 and 300 may each have a flow space for the heat exchange medium, and the flow space is formed by coupling a half-pipe-shaped header and a tank. The header of the first header tank 200 and the header of the second header tank 300 may be disposed at sides facing each other, and the tanks may be disposed outward. In addition, except for a portion of the tank of the first header tank 200 that is inserted and coupled into the header, the remaining portion of the tank of the first header tank 200 may have a cylindrical shape having an arc-shaped cross-section. In addition, the second header tank 300 may have an inlet pipe through which the heat exchange medium is introduced, and an outlet pipe through which the heat exchange medium is discharged. Baffles may be provided in the first and second header tanks 200 and 300 to partition the internal spaces, such that flow paths for the heat exchange medium may be determined by the baffles.

The plurality of tubes 400 is disposed to be spaced apart from one another side by side. One end of the tube may be inserted and coupled into the header of the first header tank 200, and the other end of the tube may be inserted and coupled into the header of the second header tank 300. Therefore, the first and second header tanks 200 and 300 may be connected to and communicate with each other by the tubes 400.

The heat radiating fins 500 may be interposed between the tubes 400 and coupled to the tubes 400 by brazing or the like. The heat radiating fins 500 may serve to improve heat exchange efficiency by receiving heat from the heat exchange medium passing through the interiors of the tubes 400 and radiating the heat to the outside.

The gas-liquid separator 600 may be formed in a cylindrical shape and disposed adjacent to and spaced apart from the first header tank 200 side by side. Further, the gas-liquid separator 600 may serve to receive the heat exchange medium from the first header tank 200 and remove moisture contained in the heat exchange medium. The gas-liquid separator 600 may serve to separate a liquid heat exchange medium and a gaseous heat exchange medium and transfer the liquid heat exchange medium to the first header tank 200.

The first pipe portion 1 of the integrated connector 100 may be inserted into a hole formed in the first header tank 200. The first seating surface 3*a*, which is a right surface of the first flange portion 3, may be in surface contact with and coupled, by brazing, to the outer peripheral surface of the tank of the first header tank 200. Further, the second pipe portion 2 may be inserted into a hole formed in the gas-liquid separator 600. The second seating surface 4*a*, which is a left surface of the second flange portion 4, may be in surface contact with and coupled, by brazing, to the outer peripheral surface of the gas-liquid separator 600.

Therefore, in the heat exchanger including the integrated connector of the present invention, the first header tank and the gas-liquid separator are coupled to or communicate with each other by using the integrated connector manufactured in a desired shape and accurate dimension. Therefore, an assembling defect is prevented at the time of assembling the first header tank, the integrated connector, and the gas-liquid separator. Further, the sealability may be assuredly maintained at the portions that are in contact with and joined to one another when the first header tank, the integrated connector, and the gas-liquid separator are coupled by brazing after being assembled. Therefore, it is possible to prevent a leak of the heat exchange medium in the heat exchanger.

In addition, the outer peripheral surface of the first header tank is coincident in shape with a surface of the integrated connector that is in contact with the outer peripheral surface of the first header tank. Likewise, the outer peripheral surface of the gas-liquid separator is coincident in shape with a surface of the integrated connector that is in contact with the outer peripheral surface of the gas-liquid separator. Therefore, it is possible to increase coupling strength between the integrated connector and the object coupled to the integrated connector. Therefore, it is possible to reduce manufacturing costs by reducing a thickness of a material used to manufacture the integrated connector.

<Method of Manufacturing Integrated Connector—Example 1>

Figure 13:
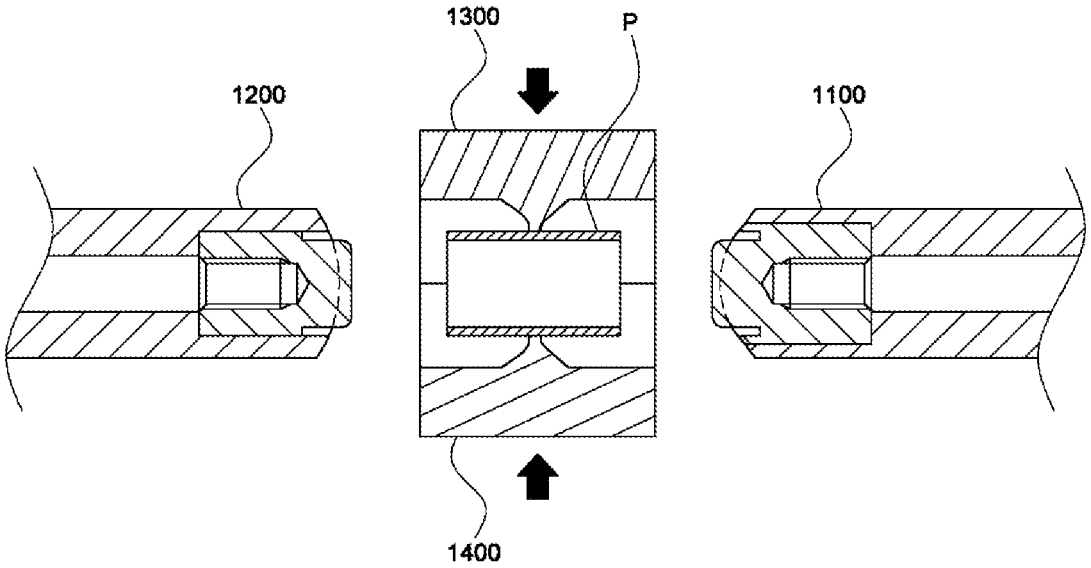
FIGS. 13 to 15 are front cross-sectional views illustrating a first embodiment of a method of manufacturing the integrated connector according to the embodiment of the present invention.
Figure 14:
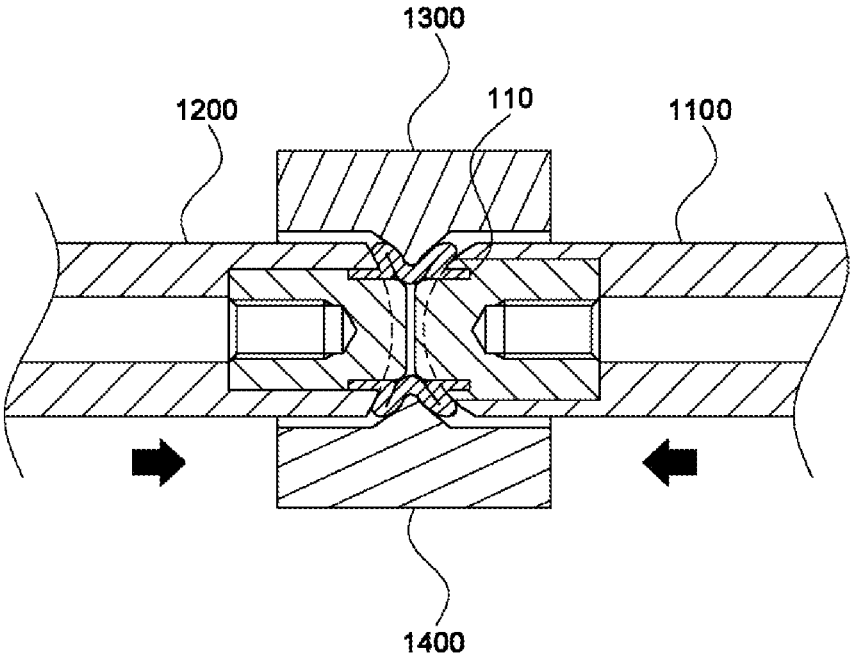
Figure 15:
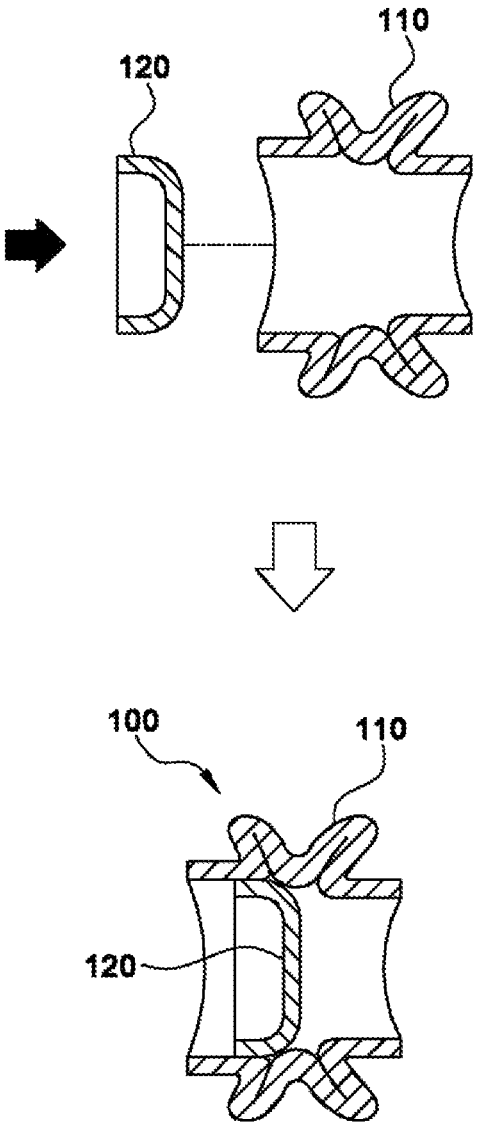

FIGS. 13 to 15 are front cross-sectional views illustrating a first embodiment of a method of manufacturing the integrated connector according to the embodiment of the present invention.

As illustrated, the method of manufacturing the integrated connector according to the first embodiment of the present invention may include a connector main body forming step and a cap coupling step.

The connector main body forming step is a step of manufacturing the connector main body 110 by pressing a pipe, which is a forming object, from two opposite sides based on the longitudinal direction. In the connector main body forming step, one pipe P, which is a forming object, may be positioned between an upper clamp 1300 and a lower clamp 1400, and the upper clamp 1300 and the lower clamp 1400 are moved in a direction in which the upper clamp 1300 and the lower clamp 1400 face each other, such that a central portion of the pipe P based on the longitudinal direction may be fixed by the upper clamp 1300 and the lower clamp 1400. Thereafter, a first die 1100 and a second die 1200, which are disposed at two opposite sides of the pipe P based on the longitudinal direction, may be moved in a direction in which the first die 1100 and the second die 1200 face each other to press the pipe P. In this case, the upper clamp 1300, the lower clamp 1400, the first die 1100, and the second die 1200 may each have a processing surface having a shape corresponding to a shape of the connector main body 110 to be manufactured. Therefore, the connector main body 110 having a desired shape may be manufactured by compressing the pipe P.

The cap coupling step is a step of press-fitting and coupling the cap 120 into the connector main body 110. The cap 120 may be press-fitted in the longitudinal direction of the connector main body 110, such that the cap 120 may block the interior of the connector main body 110 and block the connection. Therefore, the integrated connector 100 with the blocked interior may be manufactured. In this case, the cap 120 may be inserted into the connector main body 110 in a state in which the connector main body 110 is fixed to a jig. Alternatively, the connector main body 110 may be fitted with and coupled to the outer portion of the cap 120 in a state in which the cap 120 is fixed to a jig. After the cap 120 is coupled to the connector main body 110 by press-fitting, the cap 120 and the connector main body 110 may be joined and securely coupled to each other by brazing.

Further, in the cap coupling step, the cap 120 may be inserted and coupled into the connector main body 110 in a state in which a stopper is inserted first into the connector main body 110 at a side opposite to the side at which the cap 120 is inserted into the connector main body 110. In this case, the protruding stopper is formed on the jig to which the connector main body 110 is fixed by fitting. An end of the connector main body 110 may be in contact with and supported by the jig in a state in which the stopper is inserted into the connector main body 110. In this state, the cap 120 may be inserted into the connector main body 110, such that the cap 120 may be disposed at an accurate position. In addition, in case that the first and second pipe portions of the connector main body 110 have different outer diameters, the stopper is inserted into one of the first and second pipe portions that has a relatively small outer diameter, and the cap is inserted into the other of the first and second pipe portions that has a relatively large outer diameter. In this case, the stopper restricts a depth to which the cap 120 is inserted into the connector main body 110, which may prevent a shape of the portion of the connector main body, which has a relatively small diameter, from being deformed.

In addition, the pipe P is pressed and caulked from two opposite sides based on the longitudinal direction at once at the time of forming the connector main body 110 in which the first and second pipe portions have different outer diameters. Therefore, it is possible to manufacture the connector main body 110 in which the first and second flange portions have different shapes, and the first and second pipe portions have different outer diameters. Further, an optimal position, at which the cap 120 is finally disposed at the time of inserting the cap 120 into the connector main body 110, may be determined by the stopper. In addition, the stopper may be inserted into the connector main body 110 at the side opposite to the side at which the cap 120 is inserted into the connector main body 110, and the cap 120 is inserted into the connector main body 110, such that the connector main body 110 and the cap 120 may be coupled. That is, after the connector main body 110 is manufactured, the stopper may be inserted into the connector main body 110 first, and then the cap may be inserted and coupled into the connector main body 110. Alternatively, the stopper and the cap 120 may be simultaneously inserted into the connector main body 110. In this case, when the stopper and the cap 120 are simultaneously inserted into the connector main body 110, the cycle time of the manufacturing process may be shortened, thereby improving productivity. Furthermore, during the process of manufacturing the connector main body 110, the stopper and the cap 120 may be inserted into the connector main body 110, and the stopper and the cap 120 may be simultaneously inserted.

<Method of Manufacturing Integrated Connector—Example 2>

Figure 16:
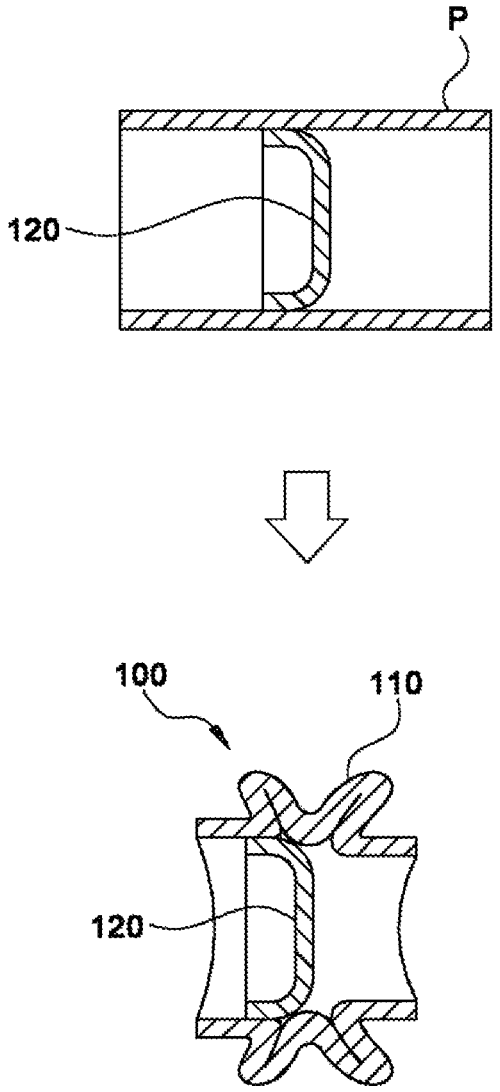
FIG. 16 is a front cross-sectional view illustrating a second embodiment of the method of manufacturing the integrated connector according to the embodiment of the present invention.

FIG. 16 is a front cross-sectional view illustrating a second embodiment of the method of manufacturing the integrated connector according to the embodiment of the present invention.

As illustrated, the method of manufacturing the integrated connector according to the second embodiment of the present invention may include a cap assembling step and a connector main body forming step.

The cap assembling step is a step of press-fitting the cap 120 into one pipe P that is a forming object. That is, the cap 120 is inserted and coupled in advance into the pipe P before the pipe P is formed by pressing. The cap 120 may be positioned at a central portion based on the longitudinal direction of the pipe P.

The connector main body forming step is identical to a step of forming the shape of the connector main body 110 according to the first embodiment of the method of manufacturing the integrated connector. However, the connector main body forming step forms the shape of the connector main body 110 in a state in which the cap 120 is coupled in the pipe P. That is, in a state in which the cap 120 is coupled in the pipe P, the pipe P may be fixed between the upper clamp 1300 and the lower clamp 1400, and then the pressing forming process may be performed. Likewise, even in the method of manufacturing the integrated connector, the connector main body 110 and the cap 120 may be joined by brazing after the connector main body 110 and the cap 120 are coupled. Therefore, it is possible to easily manufacture the integrated connector 100 in which the interior of the connector main body 110 is blocked by the cap 120.

According to the integrated connector and the heat exchanger including the same according to the present invention, it is possible to easily manufacture the connector, which connects and securely couple the header tank and the gas-liquid separator, and reduce the number of components used to manufacture the connector.

In addition, it is possible to reduce a brazing defect at the portions where the integrated connector is joined to the header tank and the gas-liquid separator.

The present invention is not limited to the above embodiments, and the scope of application is diverse. Of course, various modifications and implementations made by any person skilled in the art to which the present invention pertains without departing from the subject matter of the present invention claimed in the claims.

DESCRIPTION OF REFERENCE NUMERALS

100: Integrated connector
110: Connector main body
P: Pipe
1: First pipe portion
2: Second pipe portion
3: First flange portion
3*a*: First seating surface
4: Second flange portion
4*a*: Second seating surface
5*a*, 5*b*: First bent portion
6*a*, 6*b*: Second bent portion
7: Connection portion

7*a*: Protruding portion
120: Cap
121: Blocking portion
122: Contact portion
123: Round portion
124: Groove
125: Protrusion
126: Pleated shape
200: First header tank
300: Second header tank
400: Tube
500: Heat radiating fin
600: Gas-liquid separator
1100: First die
1200: Second die
1300: Upper clamp
1400: Lower clamp

What is claimed is:

1. An integrated connector comprising:

a connector main body including first and second pipe portions each provided in the form of a pipe, and first and second flange portions positioned between the first and second pipe portions and each formed in a shape in which the pipe is folded outward so that the folded portions overlap each other at ends of the first and second pipe portions facing each other, the connector main body having a communicating interior as the first and second pipe portions and the first and second flange portions are integrated; and a cap inserted and coupled into the connector main body and configured to block the communicating interior of the connector main body to block connection.

2. The integrated connector of claim 1, wherein the connector main body further comprises:

first bent portions configured to connect the first pipe portion and the first flange portion and connect the second pipe portion and the second flange portion;

second bent portions configured to connect radially outer side folded portions of the first flange portion and connect radially outer side folded portions of the second flange portion; and a connection portion configured to connect the first and second flange portions.

3. The integrated connector of claim 2, wherein at least a part of the cap is disposed at a position that overlaps the first or second flange portion in a longitudinal direction.

4. The integrated connector of claim 3, wherein the cap comprises:

a blocking portion configured to block an interior of the connector main body; and a contact portion extending from the blocking portion in a direction in which the cap is inserted into the connector main body, the contact portion being in contact with and coupled to the connector main body.

5. The integrated connector of claim 4, wherein the cap further comprises a round portion having a curved surface that gently connects the blocking portion and the contact portion.

6. The integrated connector of claim 4, wherein a protruding portion is formed on an inner portion of the connection portion of the connector main body and further protrudes inward than an inner peripheral surface of the first pipe portion or an inner peripheral surface of the second pipe portion, and the cap is caught by and in contact with the protruding portion.

7. The integrated connector of claim 4, wherein based on a centerline of the connection portion of the connector main body, at least a part of the blocking portion of the cap is disposed at one side based on a longitudinal direction, and the contact portion of the cap is disposed at the other side based on a longitudinal direction of the connector main body.

8. The integrated connector of claim 7, wherein based on the centerline of the connection portion, a thickness of the blocking portion of the cap, which is disposed at one side based on the longitudinal direction, is 0.3 mm to 0.4 mm.

9. The integrated connector of claim 1, wherein a protrusion or groove is formed on an outer surface of the contact portion of the cap, or an outer surface of the contact portion is formed in a pleated shape.

10. The integrated connector of claim 1, wherein a clad layer is formed on an outer surface of the cap.

11. The integrated connector of claim 1, wherein a clad layer is formed on an outer surface of the connector main body.

12. The integrated connector of claim 1, wherein the first and second pipe portions and the first and second flange portions of the connector main body are formed in an integrally connected shape by forming processing that forms the first and second flange portions folded to overlap each other by compressing one pipe.

13. The integrated connector of claim 1, wherein the first and second pipe portions of the connector main body have different outer diameters.

14. The integrated connector of claim 13, wherein the cap is inserted into one of the first and second pipe portions of the connector main body that has a relatively large outer diameter, and wherein a contact portion of the cap is disposed to be directed toward a side at which the outer diameter is relatively large, and a blocking portion of the cap is disposed to be directed toward a side at which the outer diameter is relatively small.

15. A heat exchanger comprising:

one or more header tanks configured to store a heat exchange medium and allow the heat exchange medium to flow;

a core part connected to the header tank and configured to allow the heat exchange medium to flow and perform heat exchange;

a gas-liquid separator disposed to be adjacent to and spaced apart from the header tank; and the integrated connector according to claim 1 that has one side coupled to the header tank, and the other side coupled to the gas-liquid separator.

16. The heat exchanger of claim 15, wherein the integrated connector is configured such that the first pipe portion is inserted into a hole of the header tank, the first flange portion is coupled to an outer surface of the header tank by means of surface contact, the second pipe portion is inserted into a hole of the gas-liquid separator, and the second flange portion is coupled to an outer surface of the gas-liquid separator by means of surface contact.

17. A method of manufacturing an integrated connector, the method comprising:

a connector main body forming step of integrally forming, at one side, a first flange portion, in a shape in which a pipe is folded outward so that the folded portions overlap each other, and forming, at the other side, a second flange portion, in a shape in which the pipe is folded outward so that the folded portions overlap each other, based on a central portion of the pipe based on a longitudinal direction by pressing the pipe from two opposite sides based on the longitudinal direction of the pipe in a state in which the central portion of the pipe, which is a forming object, based on the longitudinal direction is fixed, such that a first pipe portion integrally extends outward from the first flange portion in the longitudinal direction, and a second pipe portion integrally extends outward from the second flange portion; and a cap coupling step of press-fitting a cap into a connector main body so that an interior of the connector main body is blocked by the cap, and connection is blocked.

18. The method of claim 17, wherein in the cap coupling step, a stopper is inserted into the connector main body at a side opposite to the side at which the cap is inserted into the connector main body, and then the cap is inserted and coupled into the connector main body.

19. The method of claim 18, wherein the first and second pipe portions of the connector main body manufactured in the connector main body forming step have different outer diameters, and wherein the cap coupling step, the stopper is inserted into one of the first and second pipe portions that has a relatively small outer diameter, and the cap is inserted into the other of the first and second pipe portions that has a relatively large outer diameter.

20. A method of manufacturing an integrated connector, the method comprising:

a cap assembling step of press-fitting a cap into a pipe, which is a forming object, so that an interior of the pipe is blocked by the cap and connection is blocked; and a connector main body forming step of integrally forming, at one side, a first flange portion, in a shape in which the pipe is folded outward so that the folded portions overlap each other, and forming, at the other side, a second flange portion, in a shape in which the pipe is folded outward so that the folded portions overlap each other, based on a central portion of the pipe based on a longitudinal direction by pressing the pipe from two opposite sides based on the longitudinal direction of the pipe after the central portion of the pipe, which is the forming object, based on the longitudinal direction is fixed in a state in which the cap is press-fitted into the pipe, such that a first pipe portion integrally extends outward from the first flange portion in the longitudinal direction, and a second pipe portion integrally extends outward from the second flange portion.

* * * * *